US006863010B2

(12) United States Patent
Kent

(10) Patent No.: US 6,863,010 B2
(45) Date of Patent: Mar. 8, 2005

(54) FENDER COVERS

(75) Inventor: Jeannine Kent, Halifax (CA)

(73) Assignee: Nautical FX, Halifax (CA)

( * ) Notice: Subject to any disclaimer, the term of this patent is extended or adjusted under 35 U.S.C. 154(b) by 0 days.

(21) Appl. No.: 10/437,744

(22) Filed: May 14, 2003

(65) Prior Publication Data

US 2004/0011267 A1 Jan. 22, 2004

Related U.S. Application Data

(60) Provisional application No. 60/380,483, filed on May 14, 2002.

(51) Int. Cl.[7] ..... B63B 59/02
(52) U.S. Cl. ..... 114/219
(58) Field of Search ..... 114/219, 220

(56) References Cited

U.S. PATENT DOCUMENTS 4,843,994 A 7/1989 Wilson et al.
5,247,897 A * 9/1993 Pepp ..... 114/219

FOREIGN PATENT DOCUMENTS

GB 2091842 A * 8/1982 ..... B63B/59/02

OTHER PUBLICATIONS

Polyform U.S. catalog; 8/00.

* cited by examiner

*Primary Examiner*—Jesus D. Sotelo
(74) *Attorney, Agent, or Firm*—Emch, Schaffer, Schaub & Porcello Co., L.P.A.; Patrick P. Pacella

(57) ABSTRACT

Boat fender covers for use with a fender of essentially any shape and size adapted to substantially cover a fender and being so configured to receive, and remain in position around, the fender. The cover, when in place and covering the fender, does not interfere with the proper operation of the fender. Apertures are provided in the cover to allow a rope to be used, as intended, in conjunction with the fender for tying to a boat. In addition, the shape of the cover allows for good accommodation of the fender. The structure and composition of the cover provide good durability, ease of use including simple removal for washing, and characteristics which reduce abrasion to the outer side surface of a boat, including gel coatings thereon.

19 Claims, 2 Drawing Sheets

FENDER COVERS

This application claims the benefit of provisional application Ser. No. 60/380,483 filed May 14, 2002.

BACKGROUND OF THE INVENTION

The present invention generally relates to boat fender covers for use in aquatic environments to be placed on boat fenders. Boat fenders are commonly used to protect boats, docks and the like from damage. Usually, a fender is attached to the side rail of a boat or the like and hangs down along the side of the boat at times when the boat is docked or when another boat is nearby.

A problem associated with fenders is that they themselves can cause damage to the side surface finish of a boat by rubbing against its side. This effect is often amplified due to increased abrasion and chemical reaction when a fender becomes soiled. Boat surface coatings such as gel coatings are particularly sensitive to abrasion and protection of such coatings is important. Soiled fenders thus require repeated cleaning or replacement.

Fender covers have been proposed in the art; however, certain problems and inconveniences are associated with those prior developments. One of these problems is that covers are often not configured in such a way as to remain in place on the fender without bunching or falling off. Another problem is that the composition and structure of certain covers leads to significant abrasion to the side surface of the boat because of harsh fabrics or rough seams. Low durability, lack of ease of use and, unnecessary complexity are also drawbacks of certain covers adversely affecting the covers and manufacture thereof.

SUMMARY OF THE INVENTION

The present invention provides a range of fender covers adapted to be placed around boat fenders of essentially any shape and size. According to an aspect of the present invention there is provided a cover adapted to substantially cover a boat fender being so configured to receive, and remain in position around, the fender.

The cover, when in place on the fender, does not interfere with the proper operation of the fender. Apertures are provided in the cover to allow a rope to be used, as intended, in conjunction with the fender for tying to a boat. In addition, the shape of the cover allows for good accommodation of the fender.

The structure and composition of the cover provide good durability, ease of use including simple removal for washing, as well as characteristics which reduce abrasion to the side of a boat. The covers are reinforced in areas which may otherwise be susceptible to tearing and to provide improved shape retention to the cover.

According to an aspect of the present invention there is provided a boat fender cover for substantially covering a fender and being configured to receive and remain in position around the fender, the cover being sized and shaped to fit over a flangless tubular fender, the tubular fender having a longitudinal axial cavity for permitting passage of a rope therethrough; the cover having, at a first end thereof, an aperture for facilitating passage of a rope therethrough and sized marginally larger than a respective aperture in the fender; the cover having, at an opposite second end thereof, a variably sized aperture the size of which is fixable for passage of the rope therethrough and for allowing insertion of the fender into the cover, and providing a snug fit of the cover on the fender; the aperture being reducible in size to a size marginally larger than the respective aperture in the fender.

According to another aspect of the present invention there is provided a boat fender cover for substantially covering a fender and being configured to receive and remain in position around the fender, the cover being sized and shaped to fit over a tubular fender, the tubular fender having a flange at each opposite end thereof, each flange having an eye for passing a rope therethrough; the cover having, at a first end thereof, two apertures for positioning on either side of associated the eye and for passing a rope therethrough sized marginally larger than the eye of the fender; the cover having, at an opposite second end thereof, a variably sized aperture the size which is fixable for allowing insertion of the fender into the cover and for providing a snug fit of the cover on the fender; the aperture being reducible in size at least to a size marginally larger than a base of the respective flange.

According to another aspect of the present invention there is provided a boat fender cover for substantially covering a fender and being configured to receive and remain in position around the fender, the cover being sized and shaped to fit over a tubular fender, the tubular fender having a flange at one end thereof, the flange having an eye for passing a rope therethrough; the cover having, at a first end thereof, two apertures for positioning on either side of the eye and for passing a rope therethrough sized marginally larger than the eye of the fender; the cover having, at an opposite second end thereof, a variably sized aperture the size of which is fixable for allowing insertion of the fender into the cover and for providing a snug fit of the cover on the fender; the aperture being reducible in size at least to a marginal size.

DETAILED DESCRIPTION OF THE PREFERRED EMBODIMENTS OF THE INVENTION

For explanatory purposes the fender covers will be described in detail as in place substantially covering a fender.

Figure 1:
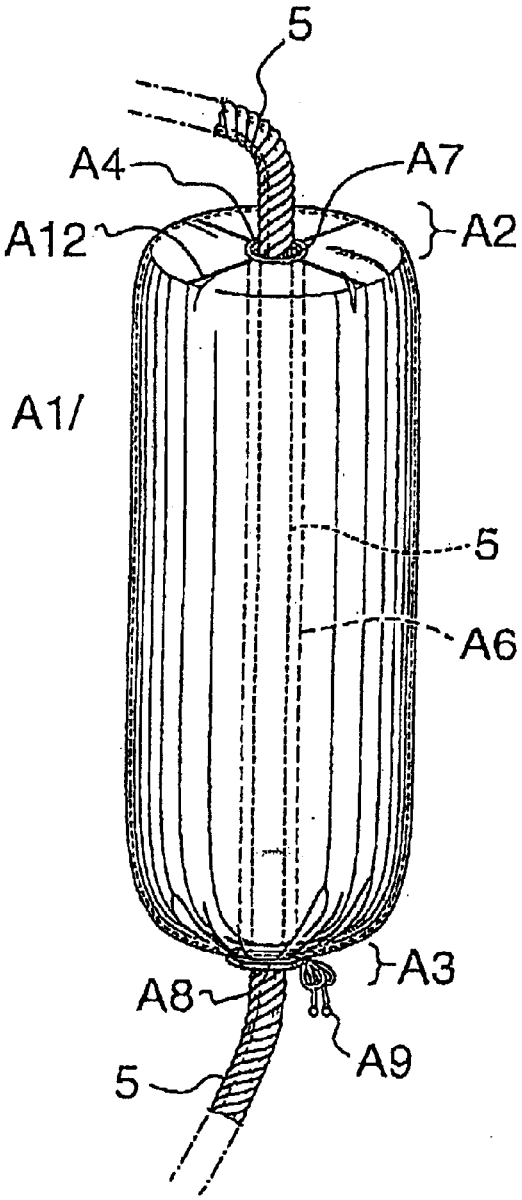
FIG. 1 illustrates a cover according to a first embodiment of the present invention in place on a flangeless type fender.

A first embodiment of the present invention, as illustrated in FIG. 1, provides a fender cover A1 adapted to fit over a tubular fender (not visible due to covering by cover A1) having a longitudinal middle cavity A6 and no flanges. The end of the cover which, when the cover and fender are hanging from a boat is closer to the sky, is defined herein as a top cover portion A2 and the opposite end is defined as a bottom cover portion A3. The top cover portion A2 of the cover A1 has an aperture A4, at one end of the longitudinal middle cavity A6, adapted to permit a rope 5 to pass therethrough. Such a rope 5, when used with fenders of the flangeless variety, passes through the longitudinal middle cavity A6 of the fender and the ends of the rope 5 are attached to a boat rail or the like. The top cover portion A2 is preferably reinforced on the interior side of the cover A1 with a material such as, for example, high nylon content polyester in order to reduce the risk of tearing. The aperture A4 is preferably surrounded by a reinforcing means A7 such as, for example, a metal or plastic grommet. The bottom cover portion A3 also has an aperture A8 (not specifically visible since it is mostly closed) at the other end of the longitudinal middle cavity A6, the size of which may be varied by a user by a varying means A9 such as, for example, a draw string or elastic. This aperture A8 is also adapted to allow the rope 5 to pass therethrough. The bottom cover portion A3 fits around the bottom of the fender thereby providing a snug fit and thus aiding to keep the cover in place on the fender before, during and after use and, in particular, to keep the bottom cover portion A3 snug around the lower part of the fender. The aperture A8 can be opened by a user to a sufficient degree as to permit the insertion of a fender into the cover A1. The top portion A2 of the cover A1 preferably includes an X-stitch A12 which extends radially from the reinforcing means A7.

Figure 2:
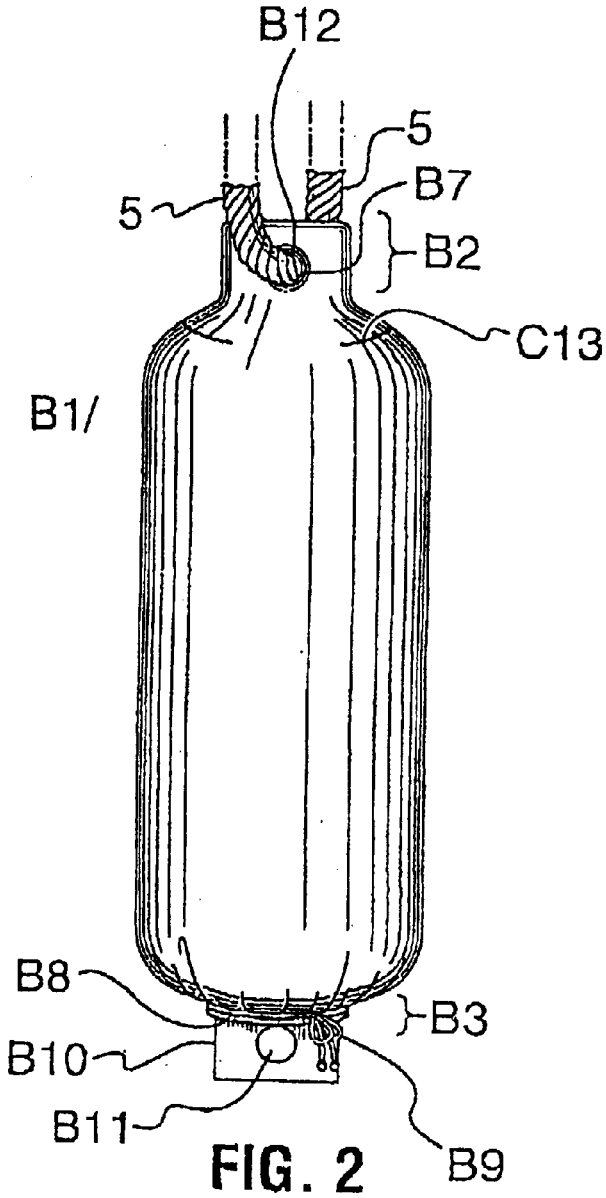
FIG. 2 illustrates a cover according to a second embodiment of the present invention in place on a two-flanged square top type fender.

A second embodiment of the present invention, as illustrated in FIG. 2, provides a fender cover B1 adapted to fit over a tubular fender having a rectangular flange B10 at each end (most of the cover including the flange at the top end are not visible due to covering by the cover B1). In general, each flange B10 has an eye B11 through which a rope 5 may pass. This embodiment is similar to the first embodiment but is adapted to accommodate the structure of a two-rectangular-flanged fender. The top cover portion B2 comprises two apertures B12, generally positioned in mutual alignment to allow a rope 5 to pass through one aperture B12, the eye B11 of the fender at the top of the fender and the other aperture B12, respectively. The bottom cover portion B3 includes an aperture B8 (not fully visible) which is adapted to be tightened around the base of the bottom flange with a varying means B9 such as, for example, a draw string or elastic. The bottom cover portion B3 fits around the bottom of the fender thereby providing a snug fit and thus aiding to keep the cover B1 in place on the fender and, in particular, to keep the bottom cover portion B3 snug around the lower part of the fender. As with the first embodiment, the top cover portion B2 is preferably reinforced on the interior side of the cover B1 with a material such as, for example, high nylon content polyester in order to reduce the risk of tearing. The apertures B12 are preferably surrounded by a reinforcing means B7 such as, for example, a metal or plastic grommet. The aperture B8 can be widened by a user to such a degree as to permit the insertion of the fender into the cover B1. A rope may also pass through the eye B11 of the flange at the bottom of the fender. The cover B1 is preferably provided with darts, i.e. stitched tapering folds C13 (two of four darts are visible in the figure) which help to provide a cover shape which is adapted to fit well with the fender and specifically the flange.

Figure 3:
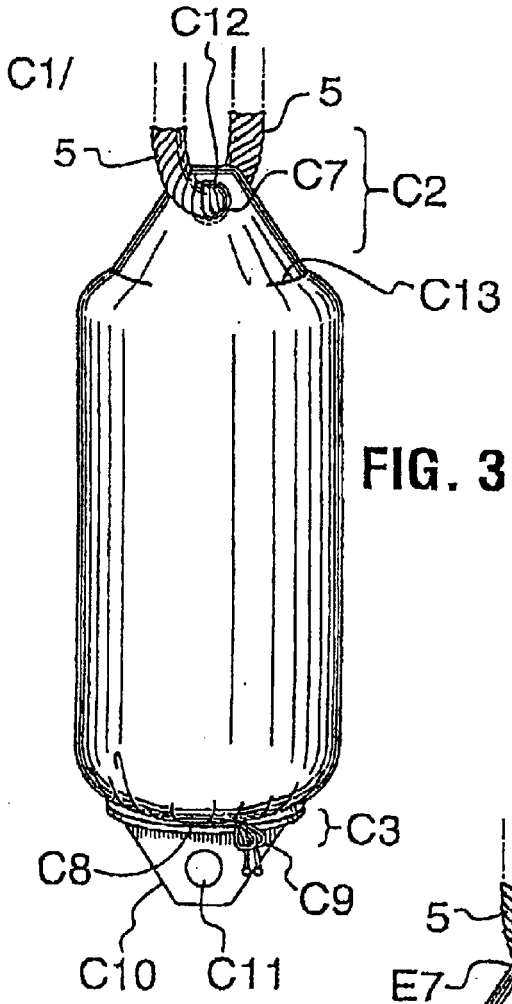
FIG. 3 illustrates a cover according to a third embodiment of the present invention in place on a two-triangular-flanged type fender.

A third embodiment of the present invention, as illustrated in FIG. 3, provides a fender cover C1 adapted to fit over a tubular fender having a triangular flange C10 at each end (most of the fender including the flange at the top end are not visible due to covering by the cover C1). In general, each flange C10 has an eye C11 through which a rope 5 may pass. This embodiment is similar to the second embodiment but is adapted to accommodate the structure of a two-triangular-flanged fender. The top cover portion C2 comprises two apertures C12, positioned to allow a rope 5 to pass through one aperture C12, the eye of the fender C11 and the other aperture C12, respectively. The bottom cover portion C3 includes an aperture C8 (not fully visible) similar to that of the second embodiment but which is adapted to be tightened around the base of a triangular flange C10. The bottom cover portion C3 fits around the bottom of the fender thereby providing a snug fit and thus aiding to keep the cover C1 in place on the fender and, in particular, to keep the bottom cover portion C3 snug around the lower part of the fender. As with the first and second embodiments, the top cover portion C2 is preferably reinforced on the interior side of the cover C1 with a material such as, for example, high nylon content polyester in order to reduce the risk of tearing. The apertures C12 are preferably surrounded by a reinforcing means C7 such as, for example, a metal or plastic grommet. The aperture C8 can be widened by a user to such a degree to permit the insertion of the fender into the cover C1. A rope may also pass through the eye C11 of the flange at the bottom of the fender. The cover C1 is preferably provided with darts C13 (two of four darts are visible in the figure) which help to provide a cover shape which is adapted to fit well with the fender and specifically the flange.

Figure 4:
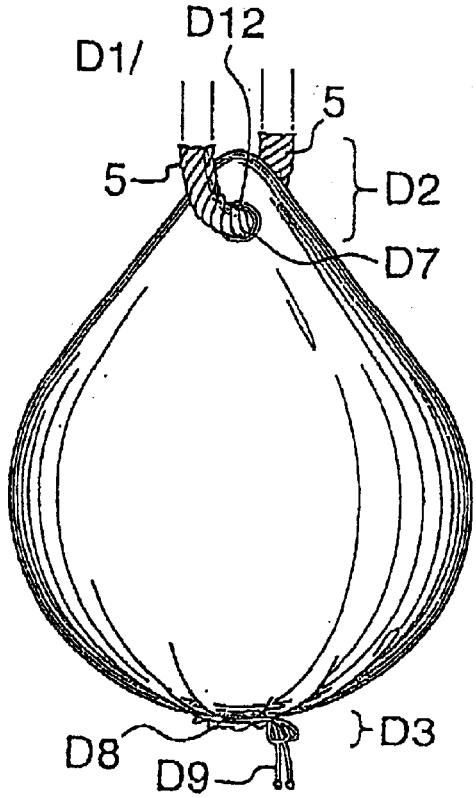
FIG. 4 illustrates a cover according to a fourth embodiment of the present invention in place on a drop shaped type fender.

A fourth embodiment of the present invention, as illustrated in FIG. 4, provides a fender cover D1 adapted to fit over a drop shaped fender having a triangular flange (the fender including the flange is covered by the cover D1 and is not visible). In general, the flange has an eye through which a rope 5 may pass. This embodiment is similar to the second and third embodiments but is adapted to accommodate the structure of a triangular-flanged drop shaped fender. The top cover portion D2 comprises two apertures D12 positioned to allow a rope 5 to pass through one aperture D12, the eye of the fender and the other aperture D12, respectively. The bottom cover portion D3 fits around the bottom of the fender thereby providing a snug fit and thus aiding to keep the cover in place on the fender and, in particular, to keep the bottom cover portion D3 snug around the lower part of the fender. As with the first three embodiments, the top cover portion D2 is preferably reinforced on the interior side of the cover D1 with a material such as, for example, high nylon content polyester in order to reduce the risk of tearing. The apertures D12 are preferably surrounded by a reinforcing means D7 such as, for example, a metal or plastic grommet. The aperture D8 at the bottom (not fully visible) can be widened by a user to such a degree as to permit the insertion of the fender into the cover D1. Since this fourth embodiment is adapted to cover a fender with a large dimension middle section relative to its ends, the bottom cover portion D3 preferably includes elastic characteristics so that the cover D1 may be inserted through aperture D8 of cover D1 without compromising good accommodation of the fender by the cover D1.

Figure 5:
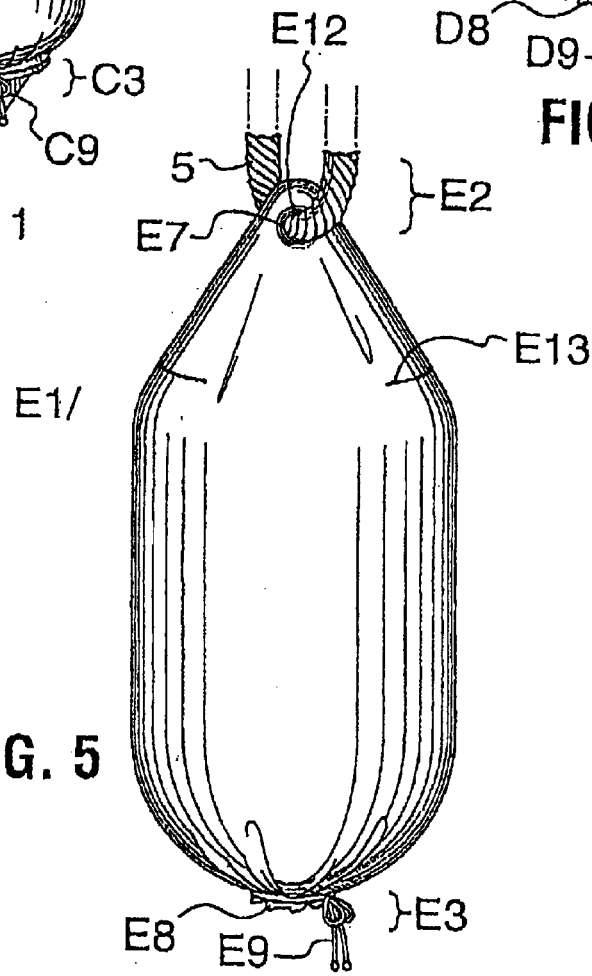
FIG. 5 illustrates a cover according to a fifth embodiment of the present invention in place on a bulged cylindrical type fender.

A fifth embodiment of the present invention, as illustrated in FIG. 5, provides a fender cover E1 adapted to fit over a bulged cylindrical type fender having a triangular flange (the fender including the flange is covered by the cover E1 and is not visible). In general, each flange has an eye E11 through which a rope 5 may pass. This embodiment is similar to the fourth embodiment in that it is adapted to accommodate the structure of a triangular-flanged fender having a large dimension middle section relative to its ends but is adapted to fit a bulged cylindrical type fender. The top cover portion E2 comprises two apertures E12 positioned to allow a rope 5 to pass through one aperture E12, the eye of the fender E11 and the other aperture E12, respectively. The bottom cover portion E3 fits around the bottom of the fender thereby providing a snug fit and thus aiding to keep the cover E1 in place on the fender and, in particular, to keep the bottom cover portion E3 snug around the lower part of the fender. As with the first four embodiments, the top cover portion E2 is preferably reinforced on the interior side of the cover E1 with a material such as, for example, high nylon content polyester in order to reduce the risk of tearing. The apertures E12 are preferably surrounded by a reinforcing means E7 such as, for example, a metal or plastic grommet. The aperture E8 can be widened by a user to such a degree to permit the insertion of the fender into the cover E1. Since this fifth embodiment is adapted to cover a fender with a large dimension middle section relative to its ends, the bottom cover portion E3 preferably comprises elastic characteristics so that the cover E1 may be inserted through aperture E8 of cover E1 without compromising good accommodation of the fender by the cover E1. The cover E1 is preferably provided with darts E13 (two of four darts are visible in the figure) which help to provide a cover shape which is adapted to fit well with the fender and specifically the flange.

The top cover portion, as described above with reference to the figures, serves an important function in the present invention. The top cover portion provides a reinforcing cap which ensures that the fender will not slide out through the top of the cover. As described above, the top portion is preferably reinforced on the interior side which reduces the risk of tearing and helps to maintain the shape of the top portion of the cover. This reinforcing cap is preferably circular to correspond to the approximate dimension of the circular top part of the fender. The reinforcing cap also provides a good medium to encircle the grommets.

FIGS. 1 to 5 illustrates, by example, several embodiments according to the present invention. In addition to those particular configurations, various fender cover configurations adapted to be used in conjunction with fenders of a variety of shapes and fender configurations are provided by the present invention. Also, the present invention provides for great variation of the absolute and relative sizes of the covers so as to accommodate the fender of choice, whether currently marketed or otherwise.

Grommets, as discussed above, may be for example ⅝ in. in diameter and may be made of brass, nickel, stainless steel or another suitable material. The size of the grommet(s) and the apertures may be varied to accommodate the particular fender and the rope to be used therewith. The cover is fabricated from a suitable material which serves to reduce the abrasion to the side of a boat and which may be used in aquatic environments. The cover may comprise surged seams or may be seamless. Preferred materials include industrial grade polar fleece or Alpine fleece made of 100% polyester having a tight weave, a density of 14 oz and anti-pilling properties. These materials help to keep the shape and structure of the cover in good condition and stretching is substantially limited to one direction. The abrasion rating of these materials is approximately 25,000 double rubs which is similar to that of a quality sofa. In a preferred embodiment of the present invention, the material has an abrasion rating of at least 20,000 double rubs. Another material which may be used is Sunbrella (trademark) which has color fastness, is water repellant and has good UV resistance. The present invention provides a cover which is washable and, in general, the material is more preferred the less it abrades outer surface coatings of a boat such as a gel coating. The material may be treated in order to repel vegetation growth and other marine organisms. An example of a suitable treatment product is Marine 3M Scotchgard (trade-mark). In a preferred embodiment of the present invention, the cover is resistant to sunlight.

What is claimed is:

1. A boat fender cover for substantially covering a fender and being configured to receive and remain in position around the fender, the cover being sized and shaped to fit over a flangless tubular fender, the tubular fender having a longitudinal axial cavity for permitting passage of a rope therethrough;

the cover having, at a first and thereof, an aperture for facilitating passage of a rope therethrough and sized marginally larger than a respective aperture in the fender;

the cover having, at an opposite second end thereof, a variably sized aperture the size of which is fixable for passage of the rope therethrough and for allowing insertion of the fender into the cover, and providing a snug fit of the cover on the fender; the aperture being reducible in size to a size marginally larger than the respective aperture in the fender, wherein the cover includes an x-stitch extending radially from the aperture at the first end.

2. A cover in accordance with claim 1, wherein said cover is made of a material selected from the group consisting of industrial grade polar fleece and alpine fleece made of 100% polyester having a tight weave and a density of approximately 14 oz. And anti-pilling properties.

3. A cover in accordance with claim 1, wherein said cover is made of a washable material suitable for durability in aquatic environments which does not abrade boat gel coating substantially and which repels to some degree vegetation or other marine organisms.

4. A boat fender cover for substantially covering a fender and being configured to receive and remain in position around the fender, the cover being sized and shaped to fit over a flangless tubular fender, the tubular fender having a longitudinal axial cavity for permitting passage of a rope therethrough;

the cover having, at a first end thereof, an aperture for facilitating passage of a rope therethrough and sized marginally larger than a respective aperture in the fender;

the cover having, at an opposite second end thereof, a variably sized aperture the size of which is fixable for passage of the rope therethrough and for allowing insertion of the fender into the cover, and providing a snug fit of the cover on the fender; the aperture being reducible in size to a size marginally larger than the respective aperture in the fender, wherein said first end includes a circular reinforcing pad for adding durability to the cover and for aiding in maintaining the shape and fit of the first end.

5. A boat fender cover for substantially covering a fender and being configured to receive and remain in position around the fender, the cover being sized and shaped to fit over a tubular fender, the tubular fender having a flange at each opposite end thereof, each flange having an eye for passing a rope therethrough;

the cover having, at a first end thereof, two apertures for positioning on either side of associated the eye and for passing a rope therethrough sized marginally larger than the eye of the fender;

the cover having, at an opposite second end thereof, a variably sized aperture the size which is fixable for allowing insertion of the fender into the cover and for providing a snug fit of the cover on the fender; the aperture being reducible in size at least to a size marginally larger than a base of the respective flange.

6. A cover in accordance with claim 5, wherein said first end is sized and shaped so as to contour in close relationship the respective flange.

7. A cover in accordance with claim 5, wherein said first end comprises darts to provide the cover with an appropriate shape to cover the fender and particularly the respective flange.

8. A cover in accordance with claim 5, wherein said cover is made of a material selected from the group consisting of industrial grade polar fleece and alpine fleece made of 100% polyester having a tight weave and a density of approximately 14 oz. and anti-pilling properties.

9. A cover in accordance with claim 5, wherein said cover is made of a washable material suitable for durability in aquatic environments which does not abrade boat gel coating substantially and which repels to some degree vegetation or other marine organisms.

10. A cover in accordance with claim 5, wherein the flanges are rectangular in shape.

11. A cover in accordance with claim 5, wherein the flanges are triangular or truncated triangular in shape.

12. A boat fender cover for substantially covering a fender and being configured to receive and remain in position around the fender, the cover being sized and shaped to fit over a tubular fender, the tubular fender having a flange at one end thereof, the flange having an eye for passing a rope therethrough;

the cover having, at a first end thereof, two apertures for positioning on either side of the eye and for passing a rope therethrough sized marginally larger than the eye of the fender;

the cover having, at an opposite second end thereof, a variably sized aperture the size of which is fixable for allowing insertion of the fender into the cover and for providing a snug fit of the cover on the fender; the aperture being reducible in size at least to a marginal size.

13. A cover in accordance with claim 12, wherein said first end is sized and shaped so as to contour in close relationship the respective flange.

14. A cover in accordance with claim 12, wherein said first end comprises stitched tapering folds to provide the cover with an appropriate shape to cover the fender and particularly the respective flange.

15. A cover in accordance with claim 12, wherein said cover is made of a material selected from the group consisting of industrial grade polar fleece and alpine fleece made of 100% polyester having a tight weave and a density of approximately 14 oz. and anti-pilling properties.

16. A cover in accordance with claim 12, wherein said cover is made of a washable material suitable for durability in aquatic environments which does not abrade boat gel coating substantially and which repels to some degree vegetation or other marine organisms.

17. A cover in accordance with claim 12, wherein the fender is drop shaped.

18. A cover in accordance with claim 12, wherein the fender is a bulged cylindrical shaped.

19. A cover in accordance with claim 12, wherein the second end is elastic.

* * * * *